US012728965B1

(12) United States Patent
O'Brien et al.

(10) Patent No.: US 12,728,965 B1
(45) Date of Patent: Sep. 8, 2026

(54) SYSTEMS AND METHODS FOR DETECTING AN ON-PLANE STATE OF A MARINE VESSEL

(71) Applicant: Brunswick Corporation, Mettawa, IL (US)

(72) Inventors: William P. O'Brien, Eden, WI (US); Ryan M. Trost, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 76 days.

(21) Appl. No.: 18/791,888

(22) Filed: Aug. 1, 2024

(51) Int. Cl.

| | |
|---|---|
| ***B63B 39/14*** | (2006.01) |
| ***B63B 39/06*** | (2006.01) |
| ***B63B 79/10*** | (2020.01) |
| ***B63B 79/40*** | (2020.01) |

(52) U.S. Cl.
CPC ..... *B63B 39/14* (2013.01); *B63B 39/06* (2013.01); *B63B 79/10* (2020.01); *B63B 79/40* (2020.01)

(58) Field of Classification Search
CPC ..... B63B 39/14; B63B 39/06; B63B 79/10; B63B 79/40
USPC ..... 701/21
See application file for complete search history.

(56) References Cited

U.S. PATENT DOCUMENTS

| | | | | |
|---|---|---|---|---|
| 4,318,699 | A * | 3/1982 | Wenstadt | B63H 20/10 440/61 G |
| 4,931,025 | A * | 6/1990 | Torigai | B63H 20/10 440/61 G |
| 9,381,989 | B1 | 7/2016 | Poirier | |
| 9,598,160 | B2 | 3/2017 | Andrasko et al. | |
| 9,896,174 | B1 * | 2/2018 | Anschuetz | B63B 79/10 |
| 10,137,971 | B2 | 11/2018 | Andrasko et al. | |
| 10,766,592 | B1 * | 9/2020 | Przybyl | F16H 61/68 |
| 11,254,402 | B1 * | 2/2022 | Poirier | F02D 41/10 |
| 11,993,352 | B1 * | 5/2024 | Witte | B63B 79/40 |
| 12,007,771 | B1 | 6/2024 | Derginer et al. | |
| 2009/0283023 | A1 * | 11/2009 | Welbourn | B63B 43/04 114/39.24 |
| 2021/0188406 | A1 * | 6/2021 | Nakatani | B63H 20/10 |
| 2021/0200244 | A1 * | 7/2021 | Kamnick | B63H 20/10 |
| 2021/0291943 | A1 * | 9/2021 | Inoue | B63B 39/061 |
| 2023/0391431 | A1 * | 12/2023 | Hamada | B63B 79/30 |

OTHER PUBLICATIONS

"Auto Glide Boat Control System Owner's Manual B Operational Instructions", 38 pages, Lenco Marine Inc., www.lencoautoglide.com.

* cited by examiner

*Primary Examiner* — Tuan C To
*Assistant Examiner* — Dominick Mulder
(74) *Attorney, Agent, or Firm* — Andrus Intellectual Property Law, LLP

(57) ABSTRACT

A system for controlling a marine vessel includes a pitch sensor configured to output pitch measurements indicative of a vessel pitch angle of the marine vessel and a controller. The controller is configured to detect that the marine vessel is in a launch state based on a speed parameter and/or the pitch measurements, detect a maximum vessel pitch based on the pitch measurements, detect a threshold decrease in pitch of the marine vessel compared to the maximum vessel pitch based on the pitch measurements, and in response to detection of the threshold decrease in pitch, determine that the vessel has reached an on-plane state.

21 Claims, 9 Drawing Sheets

SYSTEMS AND METHODS FOR DETECTING AN ON-PLANE STATE OF A MARINE VESSEL

FIELD

The present disclosure relates to systems and methods detecting an on-plane state of a marine vessel, specifically based on speed parameter(s) and/or pitch measurements.

BACKGROUND

Each of the below U.S. Patents and Applications is hereby incorporated herein by reference.

U.S. Pat. No. 9,598,160 discloses a system and method control a trim device that positions a trimmable marine apparatus with respect to a marine vessel. A trim system is operated in an automatic mode, in which a controller sends signals to actuate the trim device automatically as a function of vessel or engine speed, or a manual mode, in which the controller sends signals to actuate the trim device in response to commands from an operator input device. An operating speed of the propulsion system is determined. When the operating speed has crossed a given operating speed threshold, the trim system is subsequently operated in the automatic or manual mode depending on whether the operating speed increased or decreased as it crossed the operating speed threshold and whether the trim system was operating in the automatic or manual mode as the operating speed crossed the operating speed threshold.

U.S. Pat. No. 9,381,989 discloses a method for positioning a drive unit on a marine vessel includes receiving an initiation request from a user input device to operate the marine vessel in a desired operating mode and storing a first trim position of the drive unit in a memory upon receiving the initiation request. The method includes trimming the drive unit to a second trim position in response to the initiation request and subsequently operating the marine vessel in the desired operating mode with the drive unit in the second trim position. The method includes receiving a termination request to cancel the desired operating mode and trimming the drive unit to the first trim position automatically upon receiving the termination request. A system for positioning the drive unit is also disclosed.

U.S. Pat. No. 10,137,971 discloses a trim control system automatically controls trim angle of a marine propulsion device with respect to a vessel. A memory stores trim base profiles, each defining a unique relationship between vessel speed and trim angle. An input device allows selection of a base profile to specify an aggressiveness of trim angle versus vessel speed, and then optionally to further refine the aggressiveness. A controller then determines a setpoint trim angle based on a measured vessel speed. If the user has not chosen to refine the aggressiveness, the controller determines the setpoint trim angle from the selected base profile. However, if the user has chosen to refine the aggressiveness, the controller determines the setpoint trim angle from a trim sub-profile, which defines a variant of the relationship between vessel speed and trim angle defined by the selected base profile. The control system positions the propulsion device at the setpoint trim angle.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one aspect of the present disclosure, a system for controlling a marine vessel includes a pitch sensor configured to output pitch measurements indicative of a vessel pitch angle of the marine vessel and a controller. The controller is configured to detect that the marine vessel is in a launch state based on a speed parameter and/or the pitch measurements, detect a maximum vessel pitch based on the pitch measurements, detect a threshold decrease in pitch of the marine vessel compared to the maximum vessel pitch based on the pitch measurements, and in response to detection of the threshold decrease in pitch, determine that the vessel has reached an on-plane state.

In one embodiment, the threshold decrease in pitch is a static value calibrated for the marine vessel.

In another embodiment, the threshold decrease in pitch is an adjustable value.

In another embodiment, the controller is further configured to filter the pitch measurements to generate filtered pitch measurements, and detect the maximum pitch and the threshold decrease in pitch based on the filtered pitch measurements.

In another embodiment, wherein the speed parameter includes at least one of a vessel speed, a drive RPM, a motor torque, a motor current, and a demand value.

In another embodiment, the controller is further configured to detect that the marine vessel is in the launch state when a vessel speed of the marine vessel exceeds a launch speed threshold or when a demand value exceeds a launch demand threshold.

In another embodiment, the launch speed threshold is less than a planing speed of the marine vessel.

In another embodiment, the launch demand threshold is greater than or equal to a demand value associated with a planing speed of the marine vessel.

In another embodiment, the system further includes at least one trim actuator configured to adjust a trim position of a trimmable device, and wherein the control system is configured to control the at least one trim actuator to adjust the trim position of the at least one trimmable device in response to detecting that the marine vessel is in the on-plane state.

In another embodiment, the control system is configured to control the at least one trim actuator to place the trimmable device in a first position in response to detecting that the marine vessel is in the launch state, and to control the at least one trim actuator to place the trimmable device in a second position in response to detecting that the marine vessel is in the on-plane state.

In another embodiment, the trimmable device is a pair of trim tabs and the first position is an extended position of the pair of trim tabs and the second position where the pair of trim tabs are not in the extended position.

In another embodiment, the trimmable device is a trimmable marine drive and the first position is a tucked position and the second position is a running trim position.

In another aspect of the present disclosure, a method for controlling a marine vessel includes operating a pitch sensor to output pitch measurements indicative of a vessel pitch angle of the marine vessel, detecting that the marine vessel is in a launch state based on a speed parameter and/or the pitch measurements, detecting a maximum vessel pitch based on the pitch measurements, detecting a threshold decrease in pitch of the marine vessel compared to the maximum vessel pitch based on the pitch measurements, and in response to detection of the threshold decrease in pitch, determining that the vessel has reached an on-plane state, and control at least one marine drive, at least one steering actuator, and/or at least one trim actuator based on the on-plane state.

In one embodiment, the method further includes filtering the pitch measurements to generate filtered pitch measurements and detecting the maximum pitch and the threshold decrease in pitch based on the filtered pitch measurements.

In another embodiment, the speed parameter includes at least one of a vessel speed, a drive RPM, a motor torque, a motor current, and a demand value.

In another embodiment, the method further includes detecting that the marine vessel is in the launch state when a vessel speed of the marine vessel exceeds a launch speed threshold or when a demand value exceeds a launch demand threshold.

In another embodiment, the launch speed threshold is less than a planing speed of the marine vessel.

In another embodiment, the launch demand threshold is greater than or equal to a demand value associated with a planing speed of the marine vessel.

In another embodiment, the method further includes controlling the at least one trim actuator to adjust a trim position of a trimmable device in response to detecting that the marine vessel is in the on-plane state.

In another embodiment, the method further includes controlling the at least one trim actuator to place the trimmable device in a first position in response to detecting that the marine vessel is in the launch state and controlling the at least one trim actuator to place the trimmable device in a second position in response to detecting that the marine vessel is in the on-plane state.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
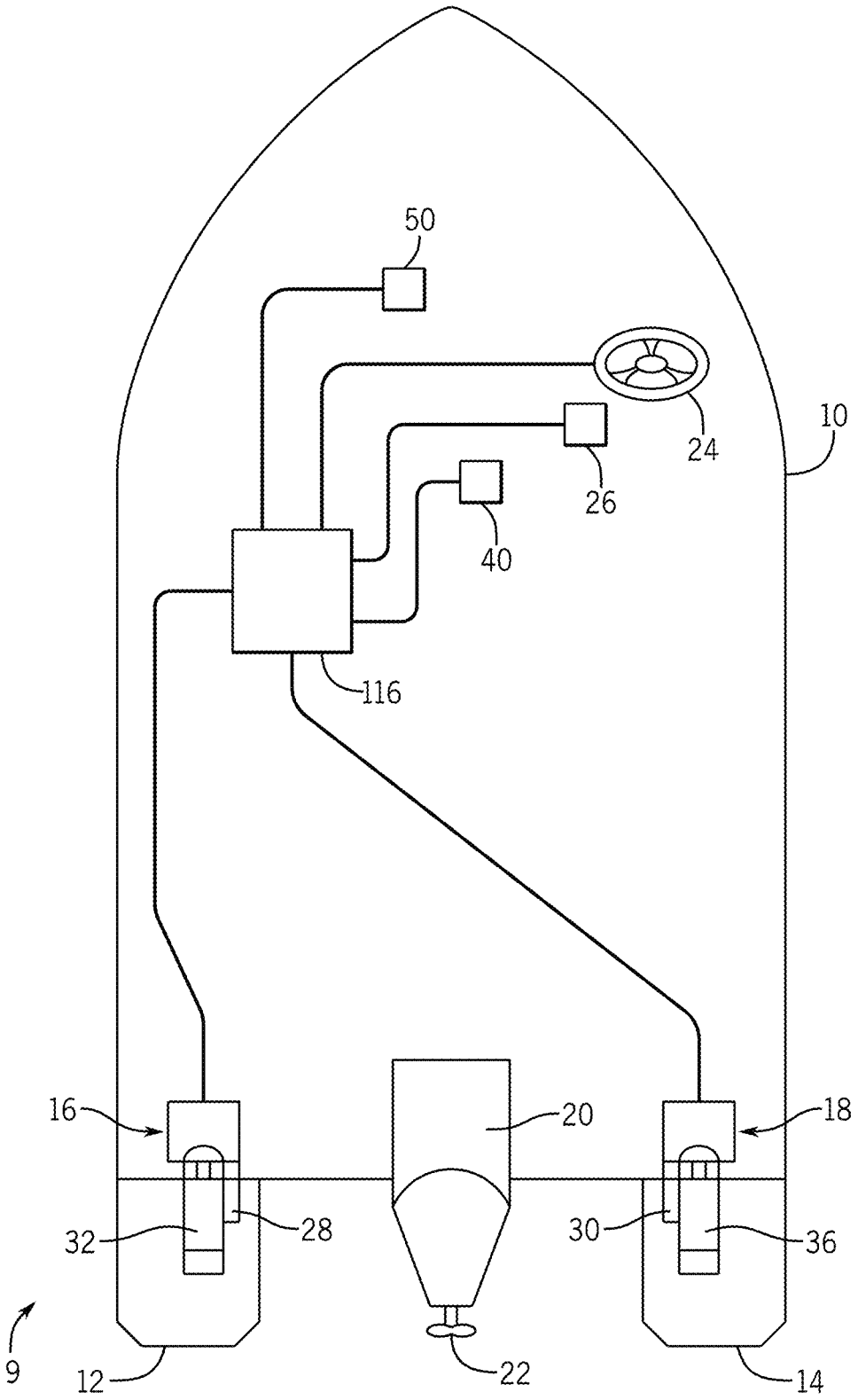
FIG. 1 illustrates one example of a marine vessel having trimmable devices coupled to its transom.

In the present description, certain terms have been used for brevity, clarity and understanding. No unnecessary limitations are to be inferred therefrom beyond the requirement of the prior art because such terms are used for descriptive purposes only and are intended to be broadly construed.

The present disclosure relates to systems and methods for controlling a marine vessel and configured to determine when the vessel has reached an on-plane state and effectuate a control strategy accordingly. The inventors have recognized that it is desirable to know when the vessel has transitioned from launch to being on-plane. The inventors have further recognized that detecting the on-plane condition of the vessel as early as possible can help optimize vessel control strategies, such as controlling trimmable devices, steering, propulsion, etc. Namely, the vessel reacts differently to trim, steering, and propulsion inputs when it is on-plane compared to when it is off-plane and the inventors have recognized that accounting for such differences can provide improved control, such as improved trim control, steering control, and/or propulsion control. By determining the transition between a launch state and an on-plane state more accurately, the control performance of the marine vessel can be improved. To provide just one example, during a rapid acceleration while the vessel is in a launch state, the tabs may be fully deployed to assist with keeping the bow down and getting the vessel to an on-plane state faster. Once the vessel has reached an on-plane state, the inventors have recognized that it is preferable to adjust the tabs out of the fully deployed position quickly, such as implementing a control strategy to adjust the tabs as needed to maintain certain desired roll and pitch angles of the vessel. If the transition between these control strategies does not occur at the correct time, it can negatively impact performance. For example, if the transition between control strategies occurs too late, the bow of the vessel may be driven down too low from the overextended tabs. If the transition happens too early, the roll control is less effective and it may delay the vessel from getting on plane or cause unwanted bow rise, requiring additional tab deflection. This, in turn, produces an increased amount of tab-induced yaw.

The inventors have developed new systems and methods for earlier detection of when the vessel reaches an on-plane state based on pitch. As disclosed in more detail below, a controller is configured to detect that the vessel has reached the on-plane state when a measured pitch of the vessel decreases by a threshold from a maximum vessel pitch angle. By continuously obtaining pitch measurements, a maximum pitch angle can be detected while in the launch state. The controller is configured to assess the continued pitch measurements and detect when a threshold decrease in pitch occurs, such as when the measured pitch angle drops by a predetermined delta angle from the maximum vessel pitch, indicating that the transition to an on-plane state has occurred. In one embodiment, the pitch measurements can be filtered before comparing the measurements to the maximum vessel pitch to detect the threshold decrease in pitch, to prevent noise or environmentally induced pitch disturbances from creating false indications of an on-plane state. When the propulsion system is not operating in the launch state, the maximum vessel pitch value is reset (such as to zero).

FIG. 1 illustrates one example of a marine vessel 10 having a system for controlling attitude, steering, and propulsion of the marine vessel 10. The marine vessel 10 has at least two trimmable marine apparatuses, here, first and second trim tabs 12, 14 connected to the transom of the marine vessel 10. The trim tab 12 is actuated by a trim actuator 16 and the trim tab 14 is actuated by a trim actuator 18. Marine vessel 10 includes a propulsion system 9 including a marine drive 20, which may be, for example, an electric drive or an internal combustion engine drive in any arrangement on the vessel, including a pod drive, inboard drive, stern drive, or outboard drive. The marine drive 20 has a powerhead (not shown), which may be an engine or an electric motor, that turns a propeller 22 to produce a thrust to propel the marine vessel 10 in a generally forward direction. The marine drive 20 is capable of rotating around a generally vertical axis in response to commands from a steering wheel 24 or autopilot section 26. The marine drive 20 may also be trimmable, as will be discussed further herein below. Also included on the marine vessel 10 are trim tab sensors 28, 30, for sensing a position of the trim tabs 12, 14. For example, the trim tab sensors 28, 30 may be Hall Effect sensors.

As mentioned, the marine vessel 10 is provided with first and second trim actuators 16, 18. The first and second trim actuators 16 and 18 may each be, for example, electric actuators, hydraulic actuators, or electric over hydraulic actuators. In the depicted example, the trim actuators 16 and 18 include a hydraulic cylinder 32, 36. The hydraulic cylinder 32, 36 operates to rotate the first trim tab 12 or the second trim tab 14, respectively, between a trimmed-out position and a trimmed-in position, or to position and maintain the trim tab 12, 14 in any desired position between these two.

Those having ordinary skill in the art will appreciate that the trim tabs 12, 14 are designed to pivot and can be actuated to different deployments with respect to the transom of the marine vessel 10. The trim actuators 16, 18 are moveable to adjust a position of the trim tab 12 or 14 with respect to the vessel 10. For example, the trim tabs can be deployed from 0% deployment where they project generally horizontally (position I), to 100% deployment (position II), where they are fully extended such that they lie at a calibrated maximum angle A with respect to horizontal. The calibrated maximum angle A at which the trim tabs 12, 14 are considered 100% deployed, or in a fully extended position, can vary based on the specifics of the marine vessel to which the trim tabs are attached. In accordance with the nomenclature provided herein, the trim tabs 12, 14 are less deployed when they lie closer to horizontal, and are more deployed when they extend at increasingly greater angles to horizontal. To put the bow of the marine vessel 10 down, both trim tabs 12, 14 are moved down to the maximum lowered position, or "trimmed-in" position, which may be used while attempting to get on-plane. For low power or trailing operation, the trim tabs are lifted to the maximum raised position, or "trimmed-out" position. The trim tabs 12, 14 can also be deployed to angles that are different from one another to create or counteract pitch or roll movements of the marine vessel 10. These different trim angles are achieved by different positions of the hydraulic cylinders 32, 36.

Figure 3:
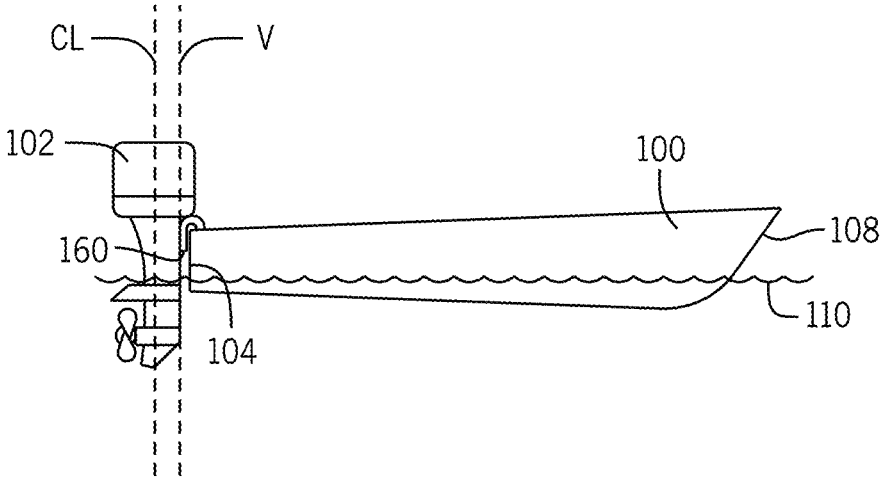
FIGS. 3-5 illustrate trim function of a trimmable outboard marine drive as another exemplary trimmable device.
Figure 4:
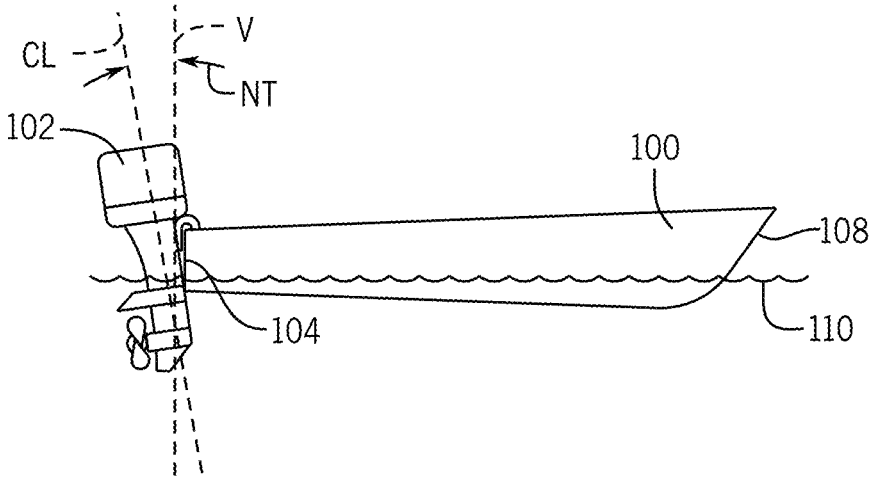
Figure 5:
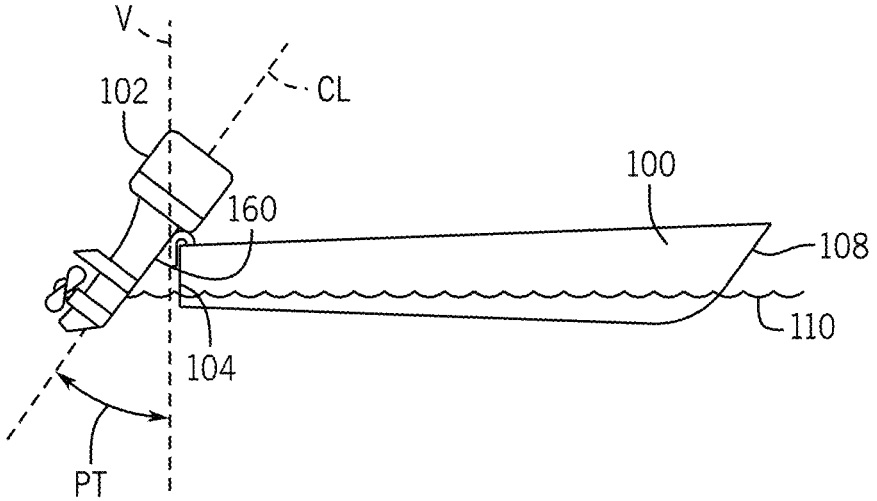

FIGS. 3-5 illustrate another example of trim function of a trimmable marine drive. In this example, the marine vessel 100 is equipped with a propulsion system including one or more trimmable marine drives 102, such as the outboard drive shown, on its transom 104. The trimmable marine drive 102 itself is connected to a trim actuator 160 that can be trimmed to different angles with respect to the transom 104. In FIG. 3, the trimmable marine drive 102 is shown in a neutral (level) trim position, in which the trimmable marine drive 102 is in more or less of a vertical position. This can be seen by comparing centerline CL of the trimmable marine drive 102 with vertical line V, where the two lines are parallel. In FIG. 4, the trimmable marine drive 102 is shown in a trimmed in (trimmed down) position. In other words, the lines CL and V will intersect below where the marine drive 102 is connected to the transom 104. This may be referred to as a negative trim angle (NT) according to an exemplary convention. In FIG. 5, the trimmable marine drive 102 is shown in a trimmed out (trimmed up) position. The lines CL and V will intersect above the marine drive's connection point to the transom 104. This may be referred to as a positive trim angle (PT). The positions in FIGS. 3 and 4 are generally used when the marine vessel 100 is operating at slower speeds. For example, the trim position shown in FIG. 3 is often used when the marine vessel 100 is in a joysticking mode or is docking. The trim position in FIG. 4 is often used during launch of the marine vessel 100, before the marine vessel 100 has gotten up to speed and on plane. In contrast, the trim position shown in FIG. 5 is often used when the marine vessel 100 is on plane and high speeds are required. At high speeds, the trim position shown in FIG. 5 causes the bow 108 of the marine vessel 100 to rise out of the water 110 as shown.

Figure 2:
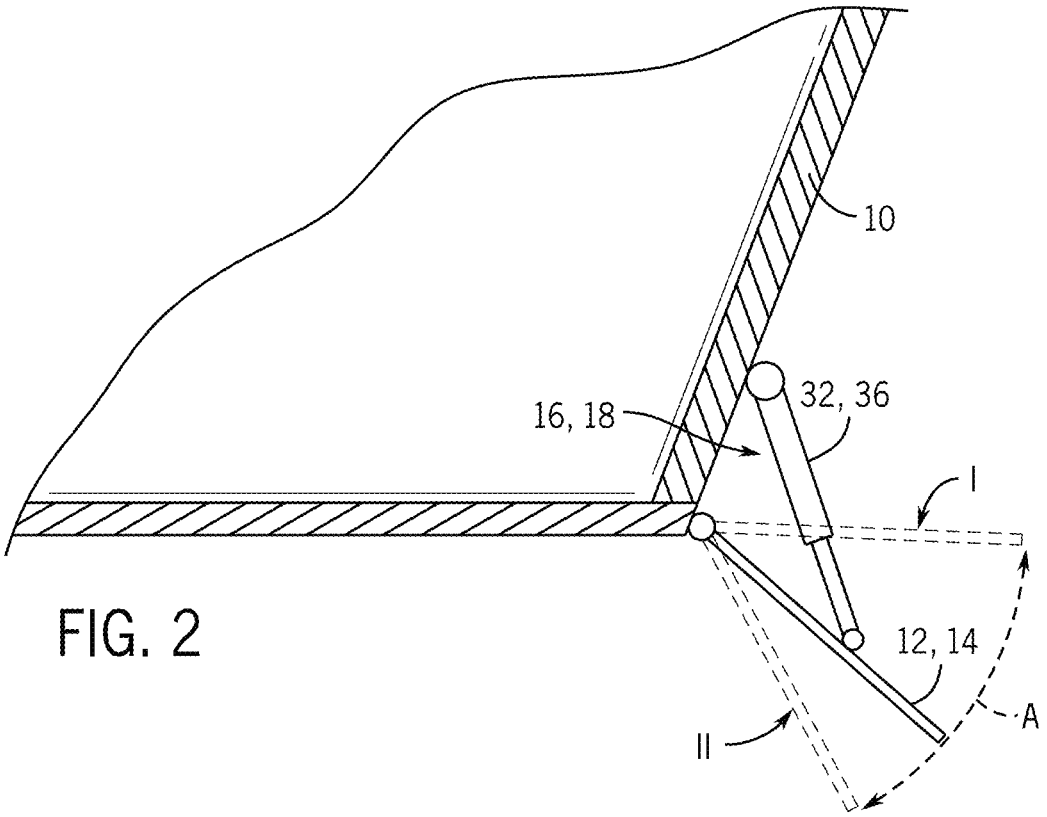
FIG. 2 illustrates trim function of trim tabs as exemplary trimmable devices.
Figure 6:
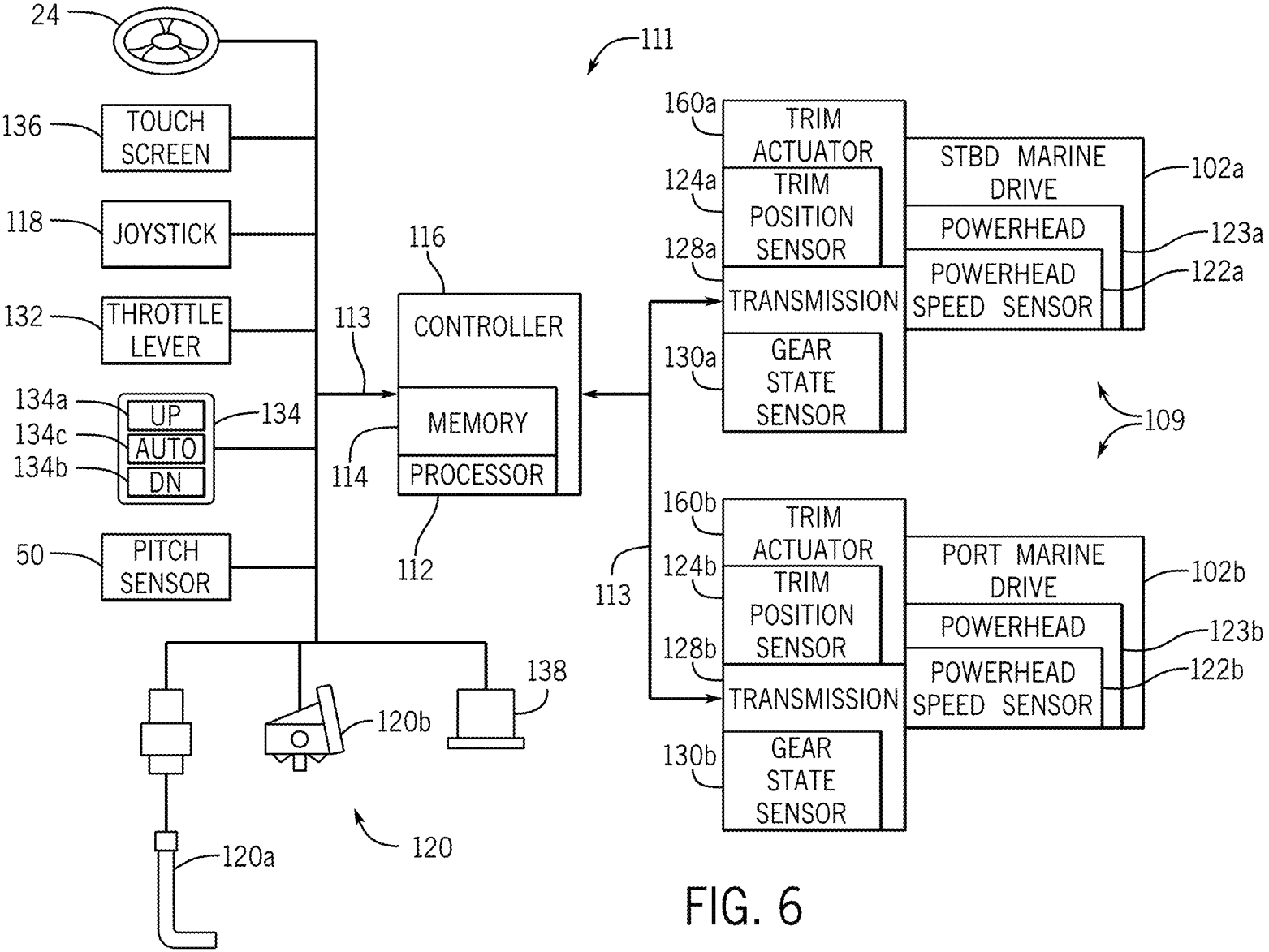
FIG. 6 illustrates one example of a control system for controlling a marine vessel according to one embodiment of the present disclosure.

FIG. 6 shows an example schematic of a trim system 111 that carries out the methods described herein. Although the specific devices and connections between the devices in the trim system 111 shown are those for a marine vessel equipped with two trimmable marine drives 102*a*, 102*b*, it should be understood that the vessel could have only one marine drive and/or could additionally be equipped with trim tabs (FIG. 1) and the principles described herein would apply. The trimmable marine drives 102*a* and 102*b* are each connected to a respective trim actuator 160*a*, 160*b*. Note that the system and method described herein are therefore applicable to a system and corresponding method for positioning any of various trimmable devices, which may include a pair of trim tabs on a transom of a marine vessel as shown in the embodiments illustrated in FIGS. 1 and 2, or may include one or more trimmable marine drives 102, 102*a*, 102*b* shown in FIGS. 3-6, or may include both trim tabs and one or more trimmable marine drives, or may include other trimmable devices configured to control vessel pitch and/or roll, such as gates, deflectors, plates, or the like.

In one example, the trim system 111 includes a controller 116 that is programmable and includes a processor 112 and a memory 114. The controller 116 can be configured to communicate with various components of the marine vessel via wired and/or wireless links, as will be explained further herein below. Although FIG. 6 shows a single controller 116, the trim system 111 can include more than one control device, such as a plurality of control devices communicatively connected and configured to act in concert to execute the methods and functions described herein. For example, the trim system 111 may include a controller 116 located at or near a helm of the marine vessel and may also include one or more controllers located at or near the marine drives 102*a*, 102*b* configured to execute instructions provided by the controller 116. Portions of the method can be carried out by a single controller or by several separate controllers. Each controller can have one or more control sections or control units. One having ordinary skill in the art will recognize that the controller 116 can have many different forms and is not limited to the example that is shown and described. For example, here the controller 116 carries out the trim control method for the trim system 111 as well as controls operation of the propulsion system 109, but in other examples separate trim control units and propulsion control units could be provided.

In some examples, the controller 116 may comprise a computing system that includes a processing system, storage system, software, and input/output (I/O) interfaces for communicating with devices such as those shown in FIG. 6, and about to be described herein. The processing system loads and executes software from the storage system, such as software programmed with a trim control method. When executed by the computing system, trim control software directs the processing system to operate as described herein in further detail. The computing system may include one or many application modules and one or more processors, which may be communicatively connected. The processing system can comprise a microprocessor (e.g., processor 112) and other circuitry that retrieves and executes software from the storage system. The processing system can be implemented within a single processing device but can also be distributed across multiple processing devices or sub-systems that cooperate in executing program instructions. Non-limiting examples of the processing system include general purpose central processing units, application-specific processors, and logic devices.

The storage system (e.g., memory 114) can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read-only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In this example, the controller 116 communicates with one or more components of the trim system 111 and the propulsion system 109 via a communication link 113, which can be a wired or wireless link. The controller 116 is capable of monitoring and controlling one or more operational characteristics of the trim system 111 and the propulsion system 109 and their various subsystems by sending and receiving control signals via the communication link 113. In one example, the communication link 113 is a controller area network (CAN) bus, but other types of links could be used. It should be noted that the extent of connections of the communication link 113 shown herein is for schematic purposes only, and the communication link 113 in fact provides communication between the controller 116 and each of the sensors, devices, and various subsystems described herein, although not every connection is shown in the drawing for purposes of clarity.

As mentioned, the controller 116 receives inputs from several different sensors and/or input devices aboard or coupled to the marine vessel. For example, the controller 116 receives a steering input from a joystick 118 and/or a steering wheel 24. The controller 116 is provided with an input from a vessel speed sensor 120. The vessel speed sensor 120 may be, for example, a pitot tube sensor 120*a*, a paddle wheel type sensor 120*b*, or any other speed sensor appropriate for sensing the actual speed of the marine vessel. The vessel speed may instead be obtained by taking readings from a GPS device 138 that calculates speed by determining how far the vessel has traveled in a given amount of time. The marine drives 102*a*, 102*b* are provided with powerhead speed sensors 122*a*, 122*b*, such as but not limited to tachometers that determine a speed of the powerheads 123*a*, 123*b* powering the marine drives 102*a*, 102*b* in rotations per minute (RPM). Trim position sensors 124*a*, 124*b* are also provided for sensing an actual position of trim actuators 16*a*, 16*b*, for example, by measuring a relative position between two parts associated with each trim actuator 126*a*, 126*b*. The trim position sensors 124*a*, 124*b* may be any type of sensors known to those having ordinary skill in the art, for example Hall effect sensors or potentiometers. Transmissions 128*a*, 128*b* and gear state sensors 130*a*, 130*b* (sensing forward, neutral, or reverse gear of the transmissions) can also be provided for each marine drive 102*a*, 102*b*. The gear state sensors 130*a*, 130*b* may be potentiometers and electronic converters, such as analog to digital converters that output discrete analog to digital counts that each represent a position of shift linkages associated with the transmissions, or may be a potentiometer sensing a position of a throttle lever 132 as signifying a gear state of the transmissions.

Other inputs can come from operator input devices such as the throttle lever 132, a keypad 134, and a touchscreen 136. The throttle lever 132 allows the operator of the marine vessel to choose to operate the vessel in neutral, forward, or reverse, as is known. The keypad 134 can be used to initiate or exit any number of control or operation modes (such as auto-trim mode) as will be described further herein below, or to make selections while operating within one of the selected modes. In one example, the operator input device such as the keypad 134 comprises an interface having at least a "trim up" input 134*a*, a "trim down" input 134*b*, and an "auto-trim on/resume" input 134*c*, shown herein as buttons. (In some systems, these input choices are labeled "bow down" and "bow up" and command movement of the trim tabs or marine drives that results in such attitude adjustment.) The controller 116 operates the trim system 111 in the manual mode in response to selection of one of the "trim up" input 134*a* and "trim down" input 134*b*. For example, a trim up command will actuate the trim actuator to trim the trim tab or trimmable marine drive up, while a trim down command will actuate the trim actuator to trim the trim tab or marine drive down. On the other hand, the controller 116 may operate the trim system 111 in the automatic mode in response to selection of the "auto-trim on/resume" input 134*c*.

In another example, the trim up and trim down buttons are provided on the handle of the throttle lever 132, and the auto-trim on/resume button is on the handle as well or placed elsewhere at the helm. The touchscreen 136 can also be used to initiate or exit any number of control or operation modes (such as trim up, trim down, or auto-trim mode), and in that case the inputs can be buttons in the traditional sense or selectable screen icons. The touchscreen 136 can also display information about the trim system 111 and/or the propulsion system 109 to the operator of the vessel, such as engine speed, vessel speed, trim angle, trim operating mode, propulsion system operating mode, etc.

The controller also receives inputs from a pitch sensor 50, wherein the pitch sensor is configured to output pitch measurements indicative of a vessel pitch angle of the marine vessel. The controller compares received inputs from the pitch sensor 50 to a maximum vessel pitch and, if the pitch measurement is greater than the current maximum vessel pitch, the controller replaces the value of the maximum vessel pitch with the pitch measurement. If a comparison of the pitch measurement and the maximum vessel pitch exceeds a delta threshold decrease in pitch, then the controller determines that the vessel has reached an on-plane state. In response to this determination, the controller controls at least one marine drive, at least one steering actuator, and/or at least one trim actuator based on the on-plane state.

As mentioned, the controller 116 selectively controls the trim system 111 in an automatic mode, in which the controller 116 sends signals to control trim automatically. The trim control of the marine drive(s) and/or trim tabs can be automatically actuated as a function of a the state of the vessel and control system, such as whether the vessel and control system are in the launch state or the on-plane state, such as according to the auto-trim algorithm provided in the software for the respective state (or mode). The trim position of trimmable devices is adjusted based on the state of the vessel, such as whether the marine vessel is in the launch state or in the on-plane state. For example, the trim position of the trimmable device(s) may be a first position when the launch state is detected and may be moved to a second position when the on-plane state is detected.

Figure 7:
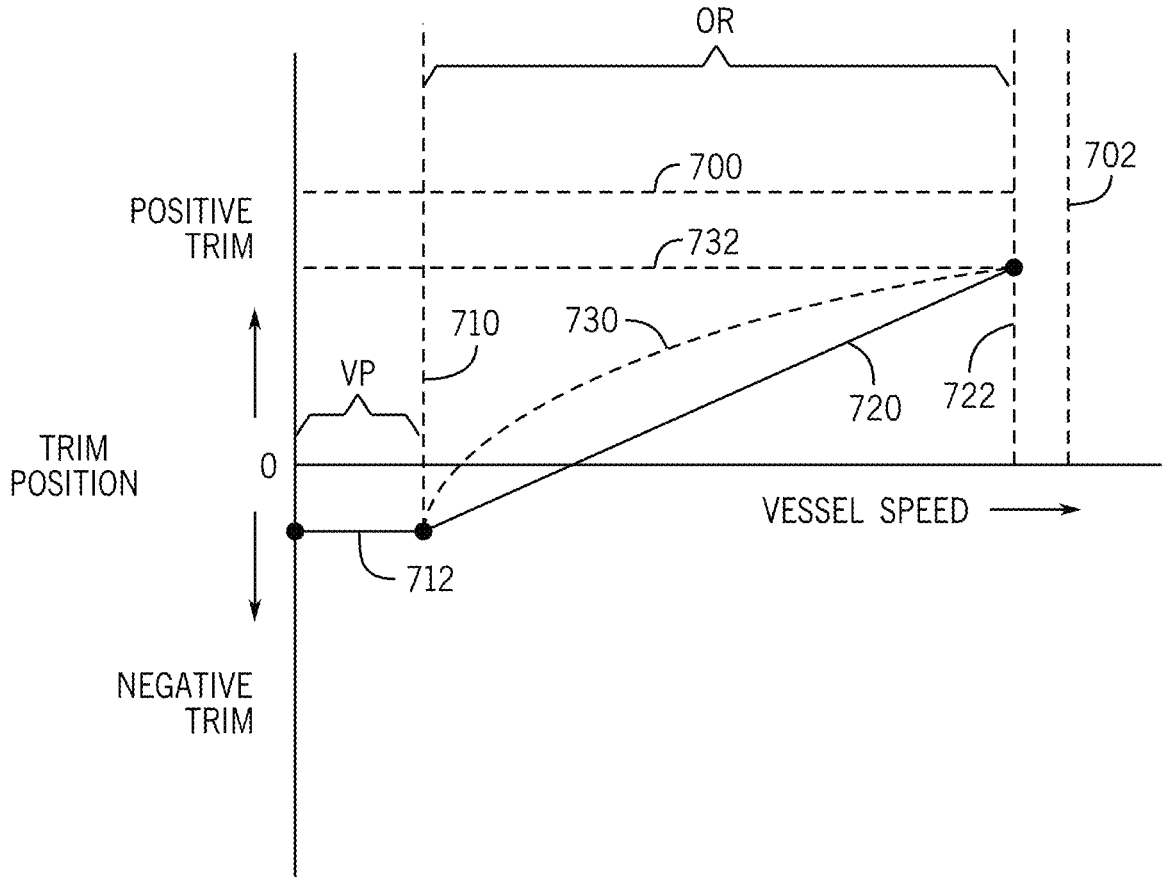
FIG. 7 is a graph illustrating one example of a relationship between trim angle and vessel speed.

FIG. 7 is a graphical representation showing an exemplary relationship between the trim angle of a trimmable marine drive 102 and the state and velocity of a marine vessel 100 according to one example of an auto-trim method. An algorithm based on marine drive speed (e.g., powerhead RPM) or other speed-related parameter(s) as an input might be exemplified by a similar relationship, although such relationships will not be shown herein in graphical form. In FIG. 7, line 700 represents a maximum positive trim angle PT of the marine drive 102 that will maintain the propeller in the water at a functional position. Dashed line 702 represents the maximum velocity of the marine vessel 100. Dashed line 710 represents an exemplary speed at which the on-plane state is detected. Line portions 712 and 720 represent the trim position as a function of change in velocity of the marine vessel 100 from a stationary condition to a high velocity threshold, where line 712 represents trim position while in the launch state and line 720 represents the trim position while in the on-plane state. The first line portion 712 represents the trim position from zero velocity to the achievement of planing state at dashed line 710. This increase in velocity is identified as VP in FIG. 7. In one example, the trim angle of the marine drive 102 is maintained at a negative magnitude of NT such as shown in FIG. 4 (i.e., a fully tucked position). This negative trim angle is maintained until the marine vessel 100 reaches planing speed shown by dashed line 710. Then, once the on-plane state is detected, the trim angle is increased.

In the depicted embodiment, the on-plane trim control is such that the trim position is increased as a function of vessel speed as exemplified by line 720 in FIG. 7. This continues until the marine vessel 100 achieves a threshold velocity, which is represented here by dashed line 722. This velocity represented by dashed line 722 is less than the maximum velocity represented by dashed line 702 of the marine vessel; however, in other examples, it could instead be at the maximum velocity. The range of speeds between dashed lines 710 and 722 is identified as its operating range OR between first and second speed magnitudes during which the trim angle is changed, according to this example, as a function of the vessel speed. In FIG. 7, this rate of change is linear as represented by line 720. However, as represented by dashed line 730, this relationship need not be linear in all applications. Dashed line 732 represents the maximum trim that is achieved during automatic trim operation when the marine vessel achieves the second speed magnitude represented by dashed line 722. In one example, this maximum trim is trim angle PT shown in FIG. 5. In other examples, the maximum trim achieved during automatic trimming is that represented by dashed line 700.

It should be understood that the relationships shown in FIG. 7 are merely exemplary, and that auto-trim systems can be programmed to operate according to various different relationships between vessel speed (or propulsion RPM) and trim position. For example, the trim position may be adjusted to a predetermined position upon detecting that the vessel is in the on-plane state. Moreover, the depicted example shows only trim of the marine drive, and a different trim control strategy would apply to controlling trim tabs.

Control of other trimmable devices, such as trim tabs, may also be adjusted based on the detected state. For example, when the launch state is the trim tabs may be deployed to a a fully extended position, such as position II shown in FIG. 2, or to some position between position I and position II. In response to detecting the on-plane state, the pair of trim tabs are adjusted to not be in the fully extended position or to a position that is less extended than the position assumed during the launch state. Thus, an initial trim position change is effectuated upon detecting the change from the launch state to the on-plane state. Once in the on-plane state, the trim tabs may be controlled based on vessel speed, measured roll, measured pitch, and/or turn commands according to various control routines. Further, on vessels with both trimmable marine drives and trim tabs, the trim routine of all trimmable devices may be coordinated and, as such, the trim routine for the marine drive may be different than that shown in FIG. 7.

Figure 8:
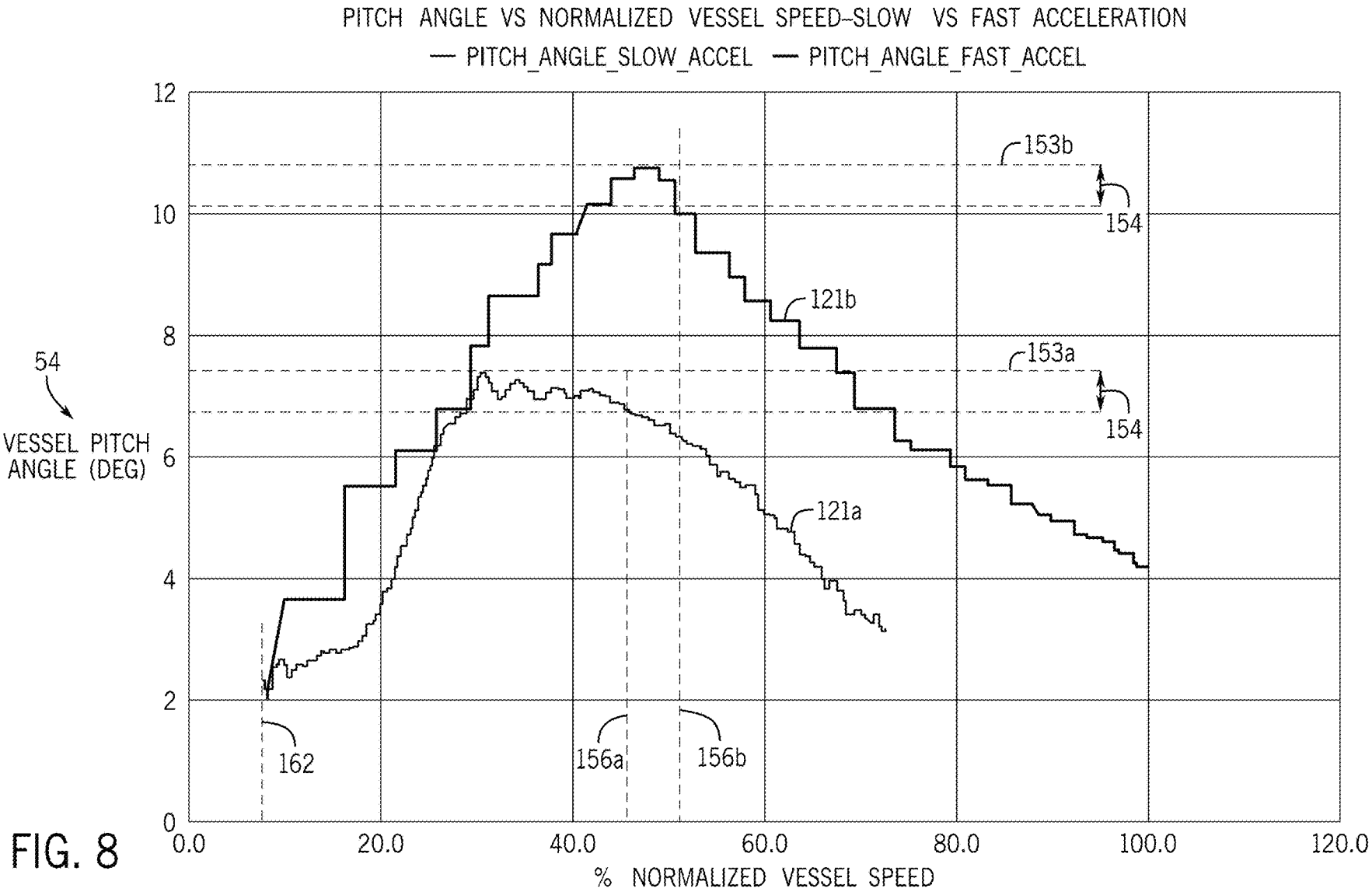
FIG. 8 is a graph illustrating on-plane behavior of marine vessels based on normalized vessel speed.

Referring to FIG. 8, a graph illustrating pitch angle versus normalized vessel speed. The graph depicts the correlation between the vessel pitch angle 54 and the normalized vessel speed. The percent normalized vessel speed includes a range from the lowest vessel speed, designated as zero, to the highest vessel speed, designated as 100%. The normalized vessel speed illustrates pitch behavior across vessels and speed ranges, where some marine vessels are configured for higher maximum speeds. The correlation between vessel pitch angle and normalized vessel speed is characterized by the line(s) 121*a* and 121*b* depicting the pitch vs. vessel speed at two different acceleration rates. Line 121*b* depicts the relationship between vessel speed and pitch during a faster acceleration than that depicted by line 121*a*. As illustrated, the velocity at which the on-plane state is reached and the maximum pitch angle reached varies depending on the acceleration pattern. Namely, faster acceleration increases the velocity at which the on-plane state is reached. Vessels following the more gradual acceleration pattern illustrated by line 121*a* reach the on-plane state at a lower velocity 156*a* than vessels following the steeper acceleration pattern illustrated by line 121*b*, which reaches the on-plane state at velocity 156*b*. Additionally, faster acceleration raises the maximum pitch angle reached. Vessels following the steep acceleration pattern illustrated by line 121*b* experience a greater maximum pitch angle 153*b* before reaching the on-plane state compared to vessels following the gentler acceleration pattern illustrated by line 121*a* where the lower maximum pitch angle 153*a* is reached.

This relationship between speed and pitch holds true across a range of speed parameters, such as a speed over ground, speed over water (as mentioned previously through use of a pitot tube or paddle wheel), a drive RPM (such as a powerhead RPM, a propeller RPM, or an RPM measured anywhere therebetween), a motor torque, and/or a demand value. The demand value may be a position of a propulsion user input device, such as throttle lever or joystick, or a propulsion demand from an autonomous navigation controller. The demand value may be, for example, a percent of the maximum demand associated with the maximum output of the powerhead.

Lines 121*a* and 121*b* show exemplary behavior of vessels at certain acceleration patterns. Acceleration patterns vary with each launch to on-plane, and thus the exact pitch and on-plane behavior will also vary. Algorithms configured to detect the on-plane state based on fixed speed and or pitch angle thresholds fail to account for the variation in pitch and on-plane behavior depending on the acceleration pattern of the vessel. The disclosed methods and systems are devised to account for the variation in pitch and on-plane behavior of the vessel by detecting a maximum pitch for the launch session and then assessing when the on-plane state is reached relative to that session-specific maximum pitch. Namely, the controller is configured to detect the maximum vessel pitch reached during launch, and then to detect the on-plane state relative to the session-specific maximum. The on-plane state is detected when the pitch angle reaches a threshold decrease in pitch from the maximum pitch. Thereby, the on-plane assessment adapts to the acceleration conditions of the particular launch session.

The controller may detect that the marine vessel is in a launch state based on a speed parameter and/or the pitch measurements. Measurement of the vessel pitch angle 54 may start when the vessel speed exceeds a launch speed threshold 162. Exceeding a launch speed threshold 162 may indicate a launch state, as opposed to moving for another purpose, such as docking.

After the launch state is detected, the controller executes a routine to detect a maximum vessel pitch based on the pitch measurements. The maximum pitch angle 153*a* reached when the vessel acceleration follows the acceleration pattern of line 121*a* is less than the maximum pitch angle 153*b* reached with the gentler acceleration pattern of line 121*b*. The on-plane state is then detected when the vessel pitch decreases by a threshold amount from the maximum pitch.

In the depicted embodiment, the threshold decrease 154 in pitch utilized for detecting the on-plane state has the same magnitude regardless of the maximum pitch value. In other embodiments, the magnitude of the threshold decrease 154 in pitch utilized for detection of the on-plane state may depend on the maximum pitch, such as a percentage of the maximum pitch. The threshold decrease in pitch may be a static value calibrated for the marine vessel or an adjustable value. For example, the value may be user configurable, such as via a user interface at the helm (e.g., from VesselView Marine Monitor or another console for interfacing with an onboard management system). Alternatively, the system may be configured to adjust the threshold decrease 154 in pitch over time-based on vessel behavior, such as via a learning algorithm configured to detect a pitch change value associated with a sustained change in pitch due to the vessel getting on-plane, to store the pitch change values over time and calculate/adjust the threshold decrease in pitch accordingly. For example, the controller may be configured to identify a delta rate of change in the pitch to identify a vessel that has a steep pitch change outside the calibrated value and then to learn a new value.

In some embodiments, the controller may be configured to use filtered pitch measurements to detect the maximum pitch and/or the on-plane state, where the pitch measured by the pitch sensor is filtered to remove the influence of momentary pitch changes due to environmental factors such as waves and wake.

Figure 9:
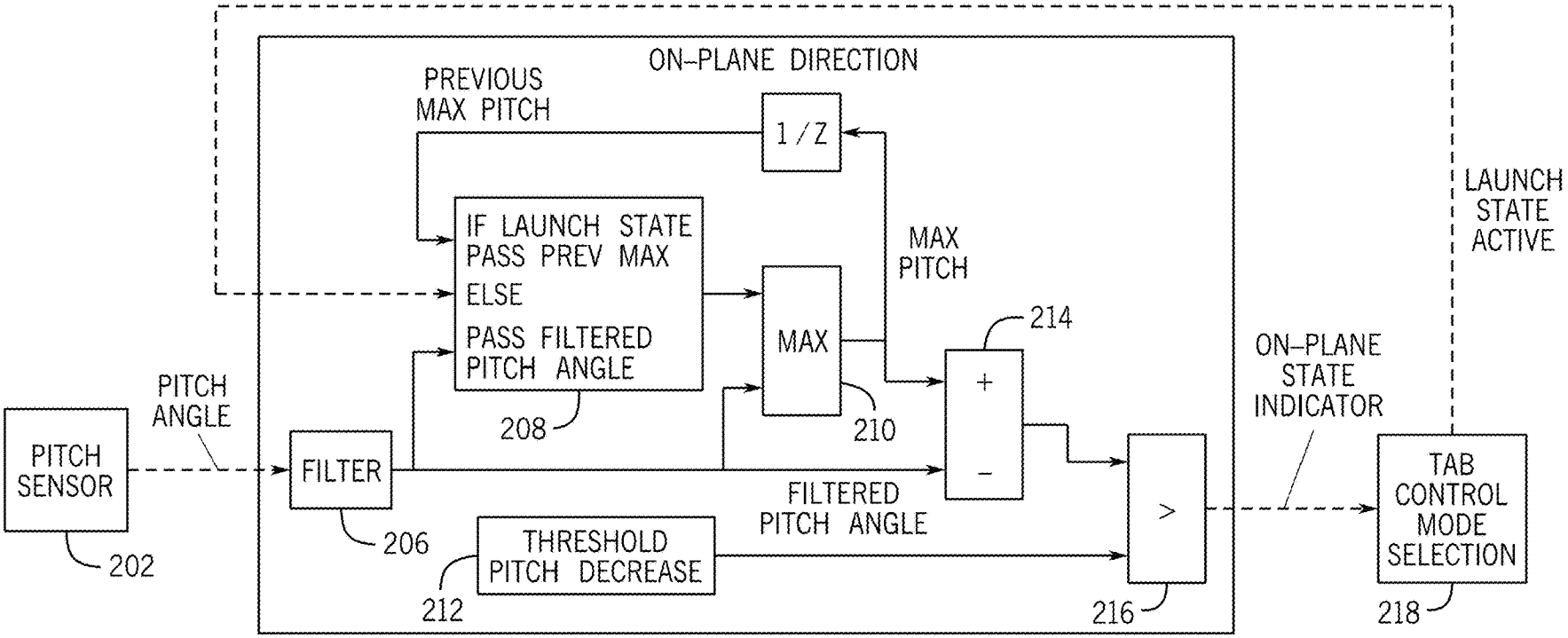
FIG. 9 illustrates a control diagram for detecting an on-plane state, according to embodiments of the present disclosure.

Referring to FIG. 9, a control diagram for detecting an on-plane state is illustrated. At step 202, the pitch sensor outputs a pitch angle that is received by the controller. The controller is configured to use the pitch angle when in a launch to determine whether the vessel has reached the on-plane state. Steps 206-216 exemplify one method of and process for determining whether the vessel has reached an on-plane state. In one embodiment, the controller is configured to filter the pitch measurements, as shown at step 206. For example, the controller may be configured to implement a moving average filter or other filter configured to smooth the pitch measurements to reduce the influence of temporary changes in pitch due to environmental factors, such as due to waves or a wake.

Logic is executed to identify the maximum pitch. The filtered pitch angle is compared to a previous maximum vessel pitch at step 210, wherein the maximum vessel pitch is the maximum pitch angle measured so far during the launch session. This value is reset to zero after each launch session. As the vessel increases in speed during launch and the pitch angle increases, the value outputted at logic step 210 will increase until the maximum pitch angle is reached—i.e., the pitch measurement with the largest vessel pitch angle replaces a previously identified maximum vessel pitch.

At step 214, the filtered pitch angle is compared to the maximum vessel pitch angle, wherein the difference between the two values is determined. At step 216, the difference between the maximum vessel pitch and the filtered pitch is compared to a threshold pitch decrease. As discussed previously, the threshold pitch decrease may be a static value, such as a value calibrated for the marine vessel, or may be an adjustable value. If the difference exceeds the threshold pitch decrease, then the on-plane state is detected and the controller outputs an on-plane state indicator, such as a flag designating that the vessel has reached an on-plane state. At step 218, the controller uses the on-plane state indicator to determine the tab control mode selection.

In such embodiments, in response to detection of the on-plane state the controller is configured to control at least one trim actuator to adjust a trim position of at least one trimmable device. For example, the controller may be configured to control the trim actuator to place the trimmable device in a first position when the marine vessel is in the launch state, and to control the trim actuator to place the trimmable device in a second position in response to detecting that the marine vessel is in the on-plane state. For example, the trimmable device(s) may be a pair of trim tabs and/or a trimmable marine drive. When the trimmable device includes a pair of trim tabs, the first position may be an extended position of the pair of trim tabs, which may be the fully extended position or may be at an extended position (e.g., between position I and position II shown in FIG. 2) and the second position may be where the pair of trim tabs are not in the fully extended position (i.e., closer to position I than the extended position). When the trimmable device includes a trimmable marine drive, the first position may be a tucked position and the second position may be a running trim position. The trimmable devices and the first and second positions may include any combination of these or other trimmable devices that are adjusted from the first position to a second position in response to detection of the on-plane state. This adjustment allows the marine vessel to operate efficiently in an on-plane state, when the dynamics of motion, control, and steering in the water differ dramatically from those of the launch state.

Figure 10:
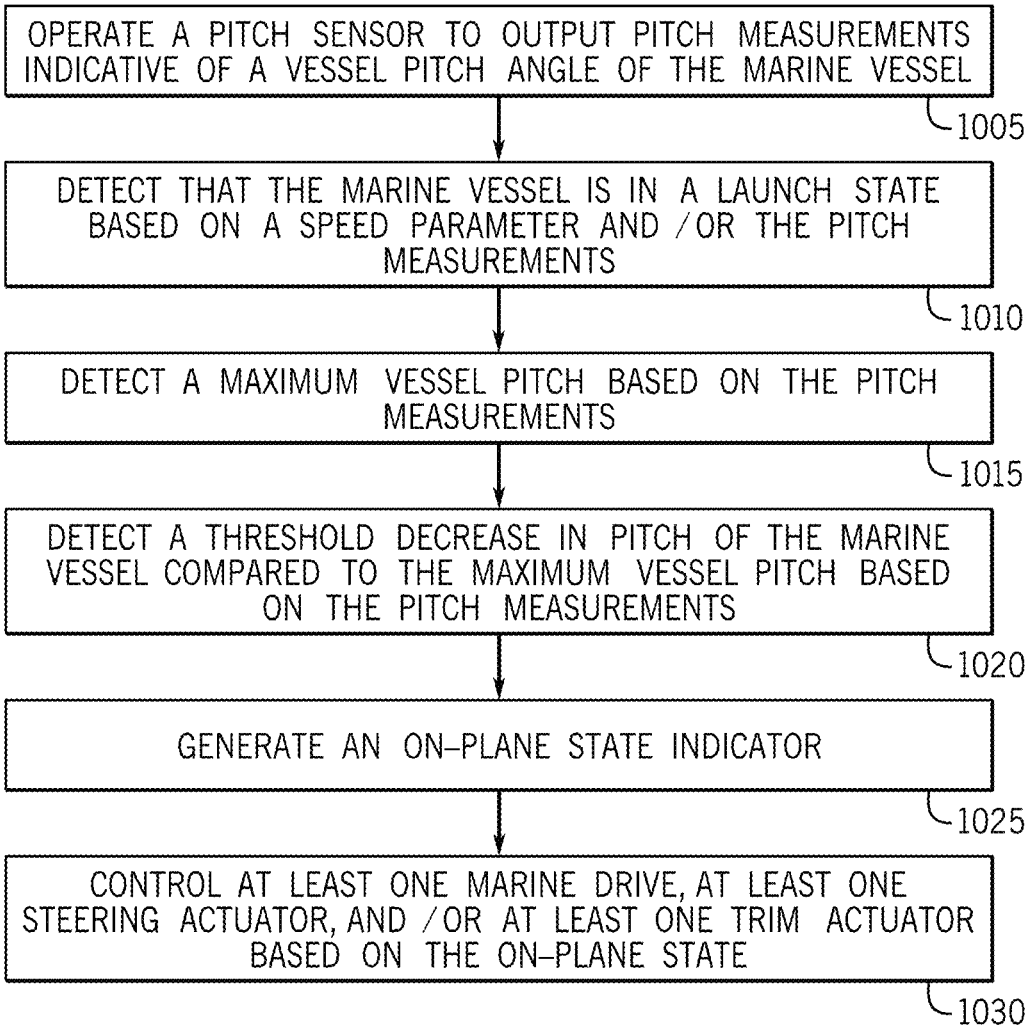
FIGS. 10-11 illustrate method steps of controlling a marine vessel, according to embodiments of the present disclosure.

Referring to FIG. 10, exemplary method steps of controlling a marine vessel are illustrated. At 1005, the controller operates a pitch sensor to output pitch measurements indicative of a vessel pitch angle of the marine vessel. At 1010, the controller detects that the marine vessel is in a launch state based on a speed parameter and/or the pitch measurements. The speed parameter may include at least one of a vessel speed (speed over water or speed over ground), a drive RPM, a motor torque, a motor current, and a demand value. A demand value may be a position of a propulsion user input device, such as throttle lever or joystick, or a propulsion demand from an autonomous navigation controller, such as a percent of the maximum demand associated with the maximum output of the powerhead. At 1015, a maximum vessel pitch is detected based on the pitch measurements. The maximum vessel pitch may be detected for the duration of a launch state, wherein the maximum vessel pitch is reset when the vessel is no longer in a launch state. At 1020, a threshold decrease in pitch of the marine vessel is detected, wherein the threshold decrease in pitch is detected compared to the maximum vessel pitch based on the pitch measurements. In one embodiment, the threshold decrease in pitch is a static value calibrated for the marine vessel. In another embodiment, the threshold decrease in pitch is an adjustable value. The value may be user configurable, such as via a user interface at the helm, or the system may be configured to adjust the threshold decrease in pitch over time based on vessel behavior, such as via a learning algorithm configured to detect a pitch change value associated with a sustained change in pitch due to the vessel getting on-plane, to store the pitch change values over time and calculate/adjust the threshold decrease in pitch accordingly. At 1025, the outputs an on-plane state indicator, such as a flag designating that the vessel has reached an on-plane state. At 1030, the controller controls one or more devices, such as the marine drive(s), at least one steering actuator, and/or at least one trim actuator, based on the on-plane state.

Figure 11:
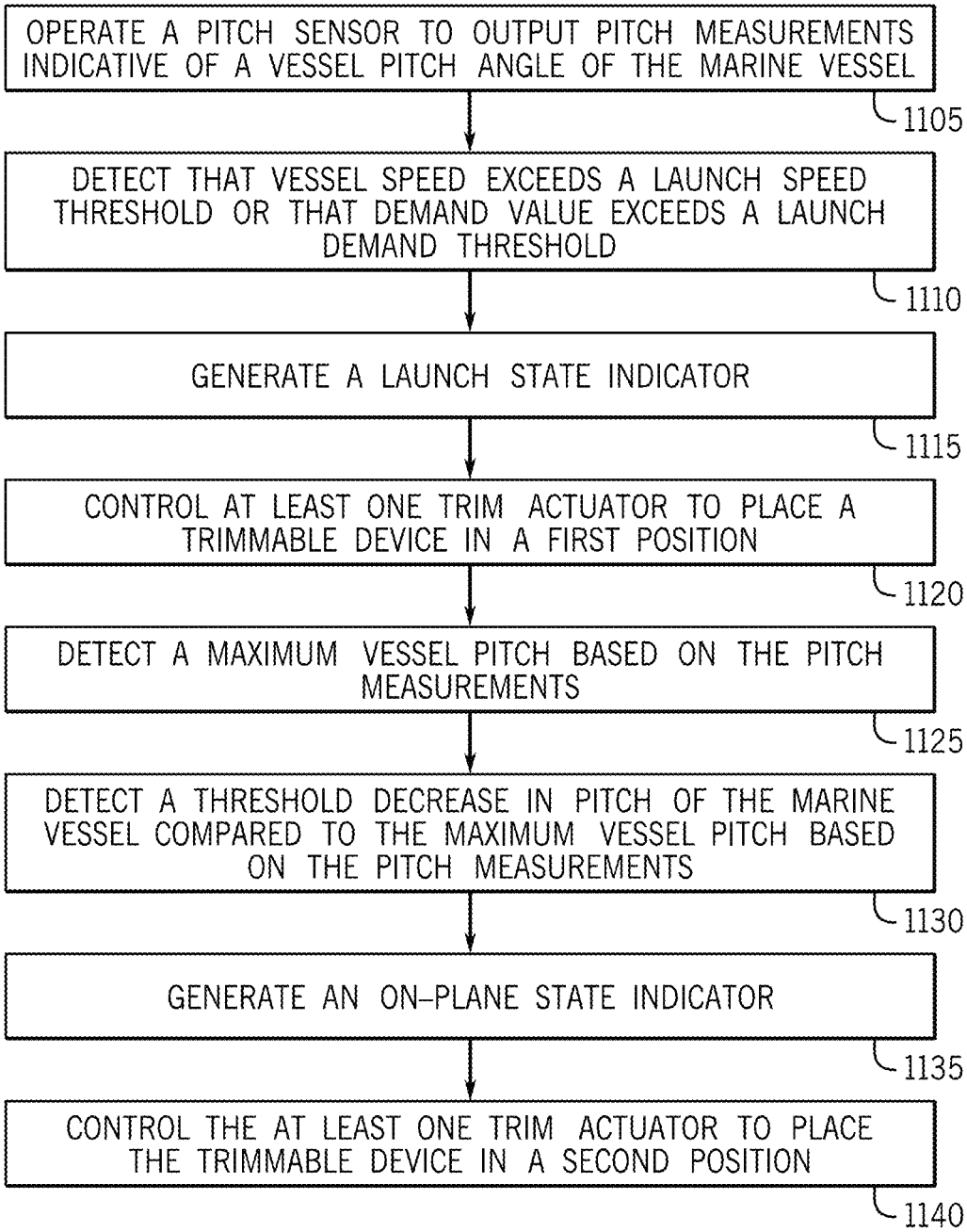

Referring to FIG. 11, exemplary method steps of controlling a marine vessel are illustrated. At 1105, the controller operates a pitch sensor to output pitch measurements indicative of a vessel pitch angle of the marine vessel. At 1110, the controller detects that the vessel speed exceeds a launch speed threshold or that demand value exceeds a launch demand threshold. In one embodiment, the launch speed threshold is less than a planing speed of the marine vessel. In another embodiment, the launch demand threshold is greater than or equal to a demand value associated with a planing speed of the marine vessel, such as a position of a user input device or a propulsion demand from an autonomous navigation controller that, if sustained, is associated with, or normally achieves, an on-plane position of the vessel. At 1115, the controller outputs a launch state indicator. At 1120, the controller controls at least one trim actuator to place a trimmable device in a first position in response to detection of the launch state. Thus, the trimmable device(s) are positioned to optimize launch, such as to help keep the bow of the marine vessel from rising too much and to help elevate the vessel as it transitions to on-plane. For example, where the trimmable device is a pair of trim tabs, the first position may be an extended position of the pair of trim tabs, which may be the fully extended position. Where the trimmable device is a trimmable marine drive, the first position may be a tucked position.

At 1125, the controller detects a maximum vessel pitch based on the pitch measurements. At 1130, a threshold decrease in the pitch of the marine vessel is detected, wherein the threshold decrease in the pitch is detected by comparison to the maximum vessel pitch based on the pitch measurements. Accordingly, the controller determines that the vessel has reached an on-plane state at 1135 and generates an on-plane state indicator. At 1140, the at least one trim actuator is controlled to place the trimmable device in a second position. Where the trimmable device is a pair of trim tabs, the second position is one where the pair of trim tabs are not in the fully extended position (e.g., closer to position I than position II). Where the trimmable device is a trimmable marine drive, the second position may be a running trim position.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A system for controlling a marine vessel, the system comprising:

a pitch sensor configured to output pitch measurements indicative of a vessel pitch angle of the marine vessel;

at least one controller comprising a processor, the at least one controller configured to:

detect that the marine vessel is in a launch state based on a speed parameter and/or the pitch measurements;

detect a maximum vessel pitch based on the pitch measurements;

detect a threshold decrease in pitch of the marine vessel compared to the maximum vessel pitch based on the pitch measurements; and in response to detection of the threshold decrease in pitch, determine that the marine vessel has reached an on-plane state.

2. The system of claim 1, wherein the threshold decrease in pitch is a static value calibrated for the marine vessel.

3. The system of claim 1, wherein the threshold decrease in pitch is an adjustable value.

4. The system of claim 1, wherein the at least one controller is further configured to:

filter the pitch measurements to generate filtered pitch measurements; and detect the maximum vessel pitch and the threshold decrease in pitch based on the filtered pitch measurements.

5. The system of claim 1, wherein the speed parameter includes at least one of a vessel speed, a drive RPM, a motor torque, a motor current, and a demand value.

6. The system of claim 1, wherein the at least one controller is further configured to detect that the marine vessel is in the launch state when a vessel speed of the marine vessel exceeds a launch speed threshold or when a demand value exceeds a launch demand threshold.

7. The system of claim 6, wherein the launch speed threshold is less than a planing speed of the marine vessel.

8. The system of claim 6, wherein the launch demand threshold is greater than or equal to a demand value associated with a planing speed of the marine vessel.

9. The system of claim 1, further comprising:

at least one trim actuator configured to adjust a trim position of a trimmable device; and wherein the at least one controller is configured to control the at least one trim actuator to adjust the trim position of the trimmable device in response to detecting that the marine vessel is in the on-plane state.

10. The system of claim 9, wherein the at least one controller is configured to control the at least one trim actuator to place the trimmable device in a first position in response to detecting that the marine vessel is in the launch state, and to control the at least one trim actuator to place the trimmable device in a second position in response to detecting that the marine vessel is in the on-plane state.

11. The system of claim 10, wherein the trimmable device is a pair of trim tabs; and wherein the first position is an extended position of the pair of trim tabs and the second position where the pair of trim tabs are not in the extended position.

12. The system of claim 10, wherein the trimmable device is a trimmable marine drive; and wherein the first position is a tucked position and the second position is a running trim position.

13. A method for controlling a marine vessel, the method comprising:

by at least one controller comprising a processor:

operating a pitch sensor to output pitch measurements indicative of a vessel pitch angle of the marine vessel;

detecting that the marine vessel is in a launch state based on a speed parameter and/or the pitch measurements;

detecting a maximum vessel pitch based on the pitch measurements;

detecting a threshold decrease in pitch of the marine vessel compared to the maximum vessel pitch based on the pitch measurements; and in response to detection of the threshold decrease in pitch, determining that the marine vessel has reached an on-plane state; and controlling at least one marine drive, at least one steering actuator, and/or at least one trim actuator based on the on-plane state.

14. The method of claim 13, further comprising:

filtering the pitch measurements to generate filtered pitch measurements; and detecting the maximum vessel pitch and the threshold decrease in pitch based on the filtered pitch measurements.

15. The method of claim 13, wherein the speed parameter includes at least one of a vessel speed, a drive RPM, a motor torque, a motor current, and a demand value.

16. The method of claim 13, further comprising detecting that the marine vessel is in the launch state when a vessel speed of the marine vessel exceeds a launch speed threshold or when a demand value exceeds a launch demand threshold.

17. The method of claim 16, wherein the launch speed threshold is less than a planing speed of the marine vessel.

18. The method of claim 16, wherein the launch demand threshold is greater than or equal to a demand value associated with a planing speed of the marine vessel.

19. The method of claim 13, further comprising controlling the at least one trim actuator to adjust a trim position of a trimmable device in response to detecting that the marine vessel is in the on-plane state.

20. The method of claim 19, further comprising:

controlling the at least one trim actuator to place the trimmable device in a first position in response to detecting that the marine vessel is in the launch state; and controlling the at least one trim actuator to place the trimmable device in a second position in response to detecting that the marine vessel is in the on-plane state.

21. The system of claim 1, wherein the at least one controller is further configured to, in response to determination that the marine vessel has reached an on-plane state, change operation of at least one marine drive, at least one steering actuator, and/or at least one trim actuator.

* * * * *